US010028584B2

(12) United States Patent
Zohar et al.

(10) Patent No.: US 10,028,584 B2
(45) Date of Patent: Jul. 24, 2018

(54) STORAGE SYSTEM

(71) Applicant: KETER PLASTIC LTD., Herzeliya (IL)

(72) Inventors: Michael Zohar, Mevasheret Zion (IL); Sharon Greenberg, Tel Aviv (IL)

(73) Assignee: KETER PLASTIC LTD., Herzeliya (IL)

( * ) Notice: Subject to any disclaimer, the term of this patent is extended or adjusted under 35 U.S.C. 154(b) by 0 days.

(21) Appl. No.: 14/902,972

(22) PCT Filed: Jul. 3, 2014

(86) PCT No.: PCT/IL2014/050599
§ 371 (c)(1),
(2) Date: Jan. 5, 2016

(87) PCT Pub. No.: WO2015/001560
PCT Pub. Date: Jan. 8, 2015

(65) Prior Publication Data

US 2016/0166059 A1 Jun. 16, 2016

Related U.S. Application Data

(60) Provisional application No. 61/843,145, filed on Jul. 5, 2013.

(51) Int. Cl.
*A47B 43/00* (2006.01)
*A47B 96/02* (2006.01)
(Continued)

(52) U.S. Cl.
CPC ..... *A47B 96/021* (2013.01); *A47B 47/0091* (2013.01); *A47B 81/00* (2013.01);
(Continued)

(58) Field of Classification Search
CPC ..... A47B 81/005; A47B 81/00; A47B 96/021; A47B 96/025; A47B 47/0091; B65D 21/0233
(Continued)

(56) References Cited

U.S. PATENT DOCUMENTS 1,925,371 A * 9/1933 Charter ..... A47B 96/025 126/339
2,065,116 A * 12/1936 Constantine ..... F25D 25/021 108/26
(Continued)

FOREIGN PATENT DOCUMENTS

EP 0325217 A2 7/1989
EP 0580967 A1 2/1994
WO 2013/080020 A1 6/2013

OTHER PUBLICATIONS

International Search Report and Written Opinion issued in a corresponding application PCT/IL2014/050599 dated Sep. 10, 2014.

*Primary Examiner* — Daniel J Troy
*Assistant Examiner* — Timothy M Ayres
(74) *Attorney, Agent, or Firm* — Dorsey & Whitney LLP

(57) ABSTRACT

Provided is a storage system including at least one shelf support and one or more modular shelves supported by the at least one shelf support. The at least one of the one or more modular shelves is configured with at least one cut-out portion extending from a front face of the one or more modular shelves towards a rear portion thereof.

15 Claims, 15 Drawing Sheets

(51) Int. Cl.

| | |
|---|---|
| ***A47B 81/02*** | (2006.01) |
| ***A47B 47/00*** | (2006.01) |
| ***A47B 81/00*** | (2006.01) |
| ***B65D 21/02*** | (2006.01) |
| *A47B 96/04* | (2006.01) |

(52) U.S. Cl.
CPC ..... *A47B 81/02* (2013.01); *B65D 21/0233* (2013.01); *A47B 96/04* (2013.01)

(58) Field of Classification Search
USPC ..... 312/206, 207, 257.1; 108/24–26.2, 27
See application file for complete search history.

(56) References Cited

U.S. PATENT DOCUMENTS 3,186,782 A * 6/1965 Ullman, Jr. ..... A47B 47/03 312/263
4,113,107 A 9/1978 Jaeger
5,327,838 A * 7/1994 Beltman ..... A47B 25/00 108/25
5,433,326 A * 7/1995 Horian ..... A47B 47/00 211/188
5,533,799 A * 7/1996 Nickolaus, Jr. ..... A47B 81/00 312/209
5,778,800 A * 7/1998 Liang ..... A47B 88/10 108/26
5,931,553 A * 8/1999 Cohen ..... A47B 47/0075 312/108
6,042,207 A 3/2000 Crosby et al.
6,099,092 A * 8/2000 Uffner ..... A47B 47/00 16/374
6,513,889 B1 * 2/2003 Park ..... A47L 13/51 312/206
6,729,371 B2 * 5/2004 Sheahan ..... B25H 1/12 108/59
6,957,876 B1 * 10/2005 DeMars ..... A47F 9/00 108/26
6,994,033 B2 * 2/2006 Kweon ..... A47B 96/025 108/94
8,376,483 B2 * 2/2013 Jung ..... F25D 25/02 211/153
8,641,158 B1 * 2/2014 Conner, Sr. ..... A47F 3/08 312/408
8,944,541 B2 * 2/2015 Allard ..... F25D 23/062 312/406
9,084,484 B2 * 7/2015 Vilkomirski ..... A47B 87/0215
9,127,877 B2 * 9/2015 Lee ..... F25D 25/024
2003/0117051 A1 6/2003 Kwen
2006/0108899 A1 * 5/2006 Jin ..... A47B 43/00 312/257.1
2011/0001415 A1 1/2011 Park et al.
2013/0160679 A1 * 6/2013 Federici ..... A47B 13/16 108/26
2014/0216957 A1 * 8/2014 Orozco ..... A47B 81/005 206/216

* cited by examiner 40
47
50
51
53
54
56
57
58
60
62
64
66

40'
53'
70
53'

40'
60'
58'
70
50'
64'
47'
54'

40'
60'
70
58'
50'
64'
47'
54'

40'
50'
70
54'

64'
57'
50'
60'
58'
51'
53'
53'
54'
53'
57'

40
47
53
54
80
84
86
88
90
92
50

40
47
54
96
98
53
50

STORAGE SYSTEM

CROSS-REFERENCE TO RELATED APPLICATIONS

The present application is a U.S. National Phase of PCT/IL2014/050599 filed on Jul. 3, 2014 claiming priority to U.S. provisional application No. 61/843,145 filed Jul. 5, 2013; the disclosure of the PCT Application is hereby incorporated by reference into the present Application.

TECHNOLOGICAL FIELD

The present disclosed subject matter is concerned with storage systems, and more particularly with such storage systems configured with modular/variable shelving.

PRIOR ART

A reference considered to be relevant as background to the presently disclosed subject matter is:

WO 2013/080020

Acknowledgement of the above reference herein is not to be inferred as meaning that this is in any way relevant to the patentability of the presently disclosed subject matter.

BACKGROUND

Storage cabinets are typically configured with one or more horizontal partitions, i.e. shelves configured for storing items thereover. Often there is a need to store generally long items such as a broom, a cob broom, a floor mop, a ladder, a vacuum cleaner, an ironing board, etc. Such items are typically stored at dedicated cabinets, or at times a cabinet is also configured with an elongate space allocated for storage of such items.

GENERAL DESCRIPTION

The term storage system, as used herein in the specification and claims denotes any storage system configured with one or more shelves, such as a stand-alone cabinet, a shelving system extending within a full or partial niche, any closed or open type of cabinet or storage system, a shelving unit etc.

The term shelf support as used herein in the specification and claims denotes any sort of shelf support mechanism, such as supports extending from side walls and optionally a back wall of the cabinet, shelf support posts, shelf support brackets, shelf support cables or chains, combinations thereof and the like.

According to the presently disclosed subject matter there is disclosed a storage system configured with at least one shelf support and one or more modular shelves supported by said at least one shelf support, wherein at least one of said one or more modular shelves is configured with at least one cut-out portion extending from a front face of the modular shelf towards a rear portion of the modular shelf.

Said cut-out portion thus forms an extended storage space spanning between the space bellow the respective modular shelf and above said respective modular shelf, thus rendering it suitable for storage of articles higher than the height of at least the space bellow the respective modular shelf.

According to a second aspect of the present disclosure the is provided a modular shelf for use with a storage system, the modular shelf comprising at least one cut-out portion extending from a front face of the modular shelf towards a rear portion of the modular shelf.

The modular shelf can be configured with a cut-out complimentary cover member, for attaching to the modular shelf and covering at least a portion of the cut-out portion.

According to another aspect of the disclosed subject matter there is provided a cut-out complimentary cover member configured for attaching to a modular shelf of a storage system, for covering at least a portion of a cut-out portion of said modular shelf.

According to yet an aspect of the present disclosure there is disclosed a cut-out complimentary cover member configured for attaching to a modular shelf of a storage system, said cut-out complimentary cover member configured for covering at least a portion of a cut-out portion of said modular shelf. The cut-out complimentary cover member at least partially conforms with the shape and size of the cut-out portion of the modular shelf.

Any one or more of the following features, designs and configurations can be implemented with a storage cabinet or shelf subject of the presently disclosed subject matter, in single form of in combinations thereof:

- The storage system can be a cabinet, fitted with one or more doors;
- The storage system can be made of molded plastic material;
- The one or more modular shelves can be made of molded plastic material;
- The cut-out portion of the one or more modular shelf has an opening configured at a front face of the modular shelf;
- The cut-out portion of the modular shelf is configured for removably receiving a complimentary cut-out cover member;
- The cut-out complimentary member can be configured with at least a surface portion extending flush with at least a top face of the modular shelf;
- The storage system can extend within a complete or partial niche, wherein one or both side supports are part of a wall or other receiving structure. Likewise, any one or more of the storage system's back wall, top wall and bottom wall can be part of the niche;
- The cut-out portion can extend proximally to a rear edge of the modular shelf, however maintaining at least a rear continuous edge opposite an open edge of the cut-out (i.e. an edge opposite an open edge of the cut-out portion);
- The cut-out portion can be configured at any shape having an opening at a front face of the modular shelf. Accordingly, the cut-out portion can be configured as rectangle, a U-like shape, a circular portion, etc.,
- The complimentary cut-out cover member can be configured for detachably attachment over or within a portion of the cut-out portion;
- The complimentary cut-out cover member can be configured for sliding or pivotal displacement between a complimenting position, wherein it at least partially compliments the cut-out portion, and an open position wherein it is displaced from the cut-out portion;
- Side walls of the cut-out portion can be configured with rails (groves and/or projections) for slidingly receiving a respective with a Sliding cover/box complimentary cut-out cover member configured with respective opposite rail engaging members (i.e. groves and/or projections);

The complimentary cut-out cover members can be box-like elements configured for nestable stacking while not in use as shelf complimentary members;

One or both of the complimentary cut-out cover member and the cut-out portion of the modular shape can be configured with a locking/arresting mechanism, for retaining the complimentary cut-out cover member at either of its respective complimenting position and open position;

The complimentary cut-out cover member can be configured with a storage compartment, configured as a box or drawer-like compartment;

The complimentary cut-out cover member can be can be a compartmented storage compartment;

The complimentary cut-out cover member can be configured with a first side being a substantially flat surface complimenting a top surface of the shelf, and a second side being a storage compartment, wherein the complimentary cut-out cover member can be articulated with the cut-out portion with either its first side or its second side facing upwards;

The complimentary cut-out cover member can be thicker than the thickness of the respective modular shelf;

The modular shelf can be reinforced at the vicinity of the cut-out portion;

The modular shelf can be reinforced along a portion of a rear edge thereof, at least opposite the cut-out portion;

The one or more cut-out portions can be configured at any location along the front face of the modular shelf;

The modular shelf can be configured with one or more cut-out portions also at a rear face of the modular shelf and extending towards a front portion of the modular shelf, respectively;

The cut-out portion of two or more neighboring shelves can extended in full, partial or no alignment (overlapping);

The cut-out complimentary cover member can extend over the entire cut-out portion or a respective portion thereof;

The cut-out portion can be covered by one or more cut-out complimentary cover members;

One or more support posts can be configured for supporting the one or more modular shelves. Such a support post can be modular or telescopic, so as to comply for varying height of shelves. The support post can be configured for engaging with a respective portion of a shelf (a modular shelf or a regular shelf);

The support post can be configured for extending from either or both a top and a bottom of the storage system (i.e. bearing or suspending the one or more shelves);

The support post can be configured for articulation with respective one or more shelves at their font edge;

The support post can be configured for articulation with respective one or more shelves adjacent the cut-out portions;

A cut-out portion of a shelf can be configured with an elevated rim portion, facilitating accommodation of thicker cut-out complimentary cover members The modular shelf can be reinforced by different arrangements, such as core-type formations, ribs, reinforcing elements articulated or integrated with the shelf, etc. and combinations thereof.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which:

FIG. 2 is the same as FIG. 1A, however with all cut-out complimentary cover members removed;

DETAILED DESCRIPTION OF EMBODIMENTS

Figure 1B:
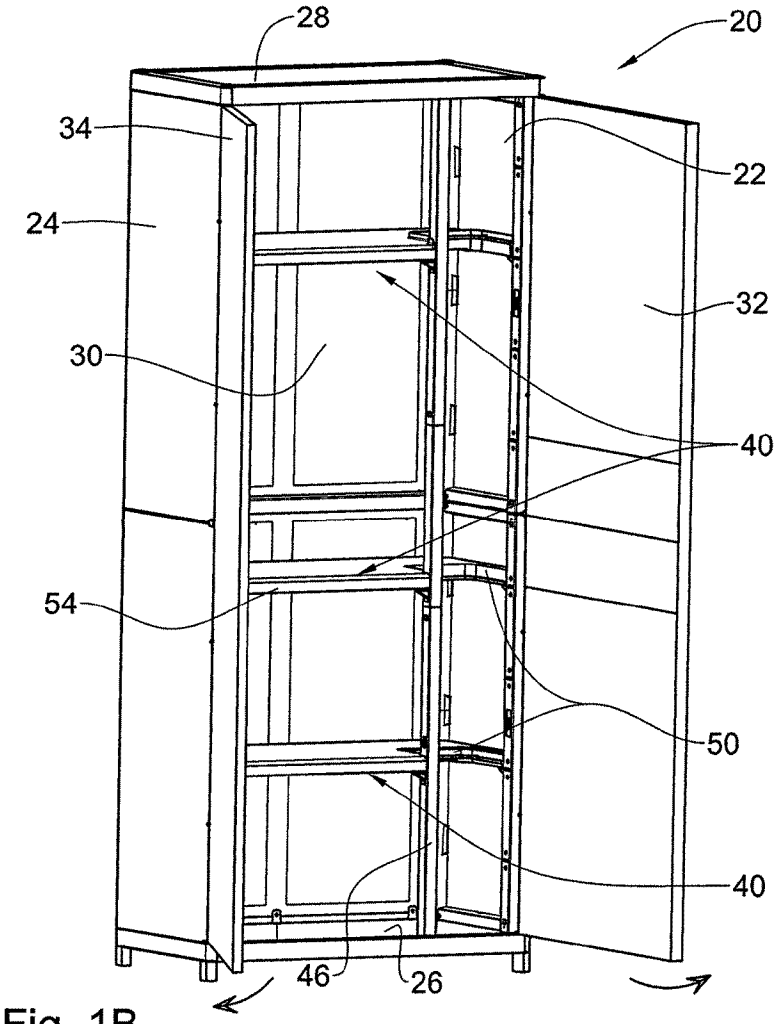
FIG. 1B illustrates the storage cabinet of FIG. 1A with all cut-out complimentary cover members removed.
Figure 1A:
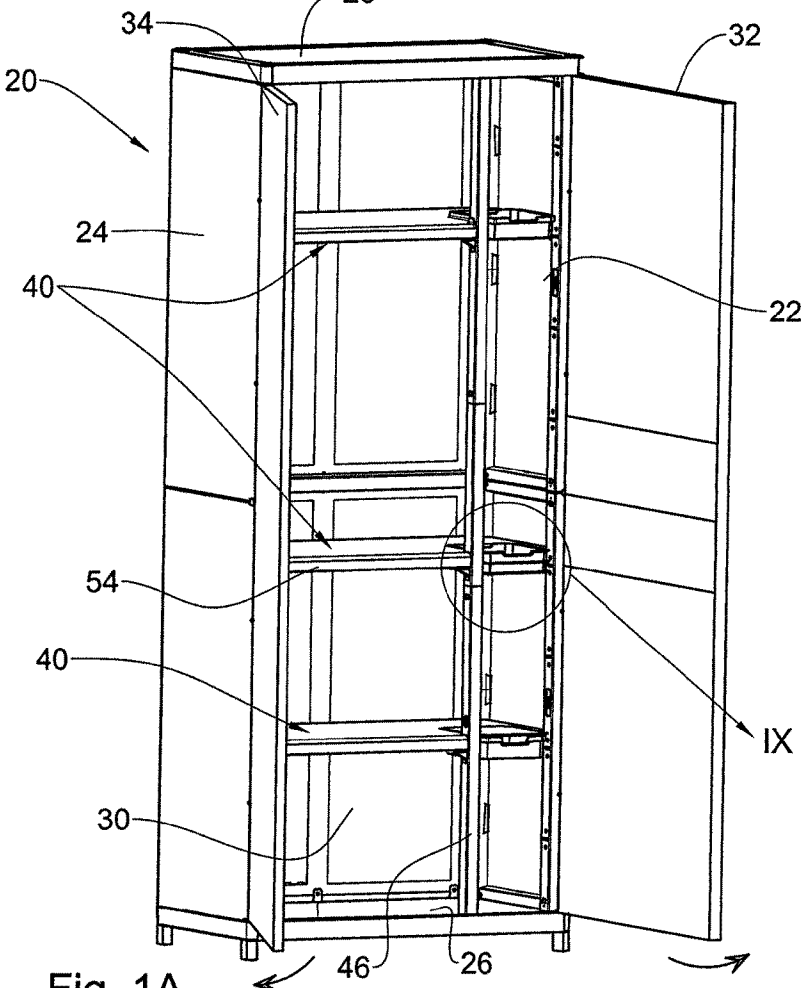
FIG. 1A is a left perspective view of a storage cabinet according to the disclosed subject matter, with its front doors open and all cut-out complimentary cover members received at their respective shelves.
Figure 1C:
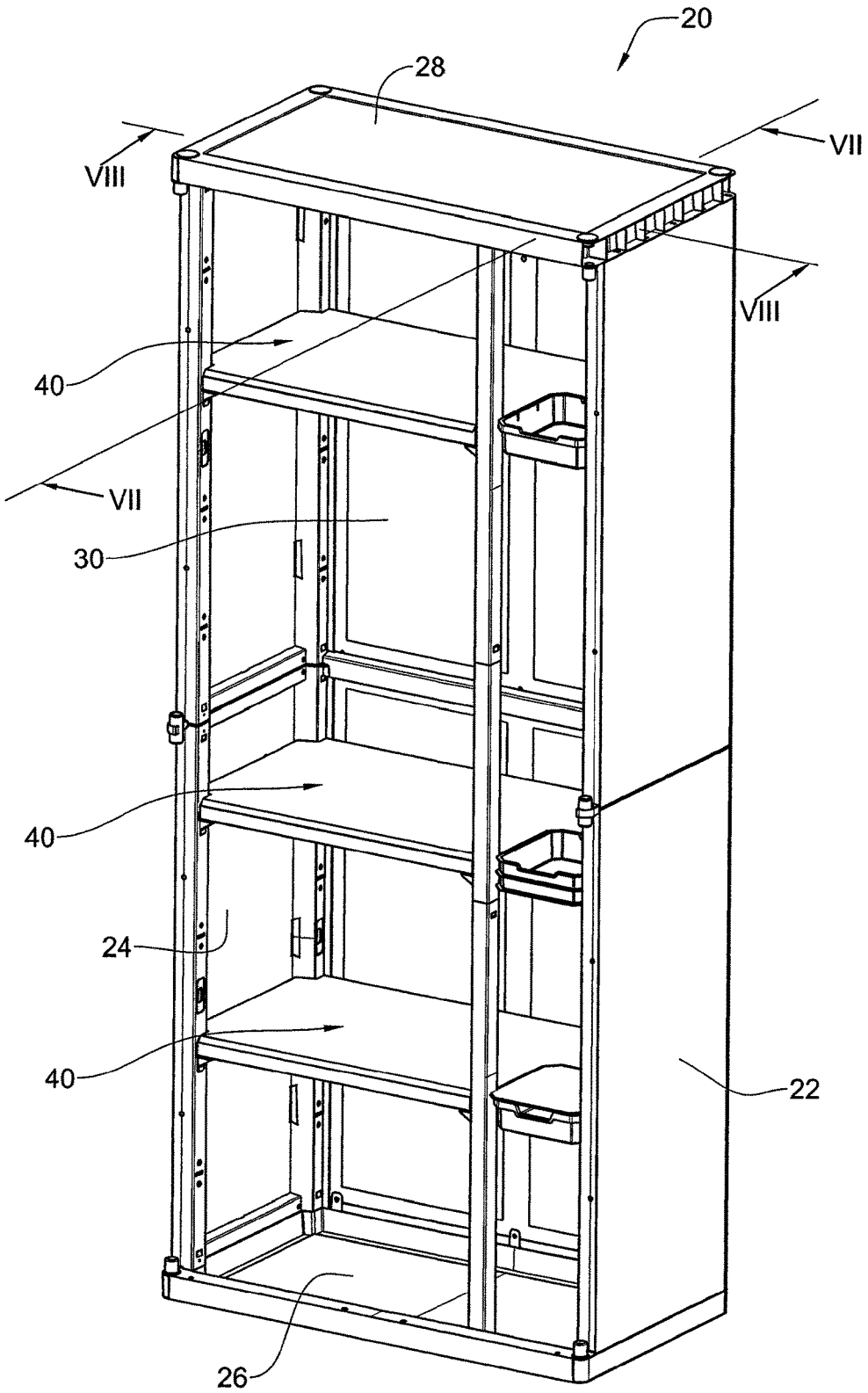
FIG. 1C is a right side perspective view of the storage cabinet of FIG. 1A, the doors removed.
Figure 1D:
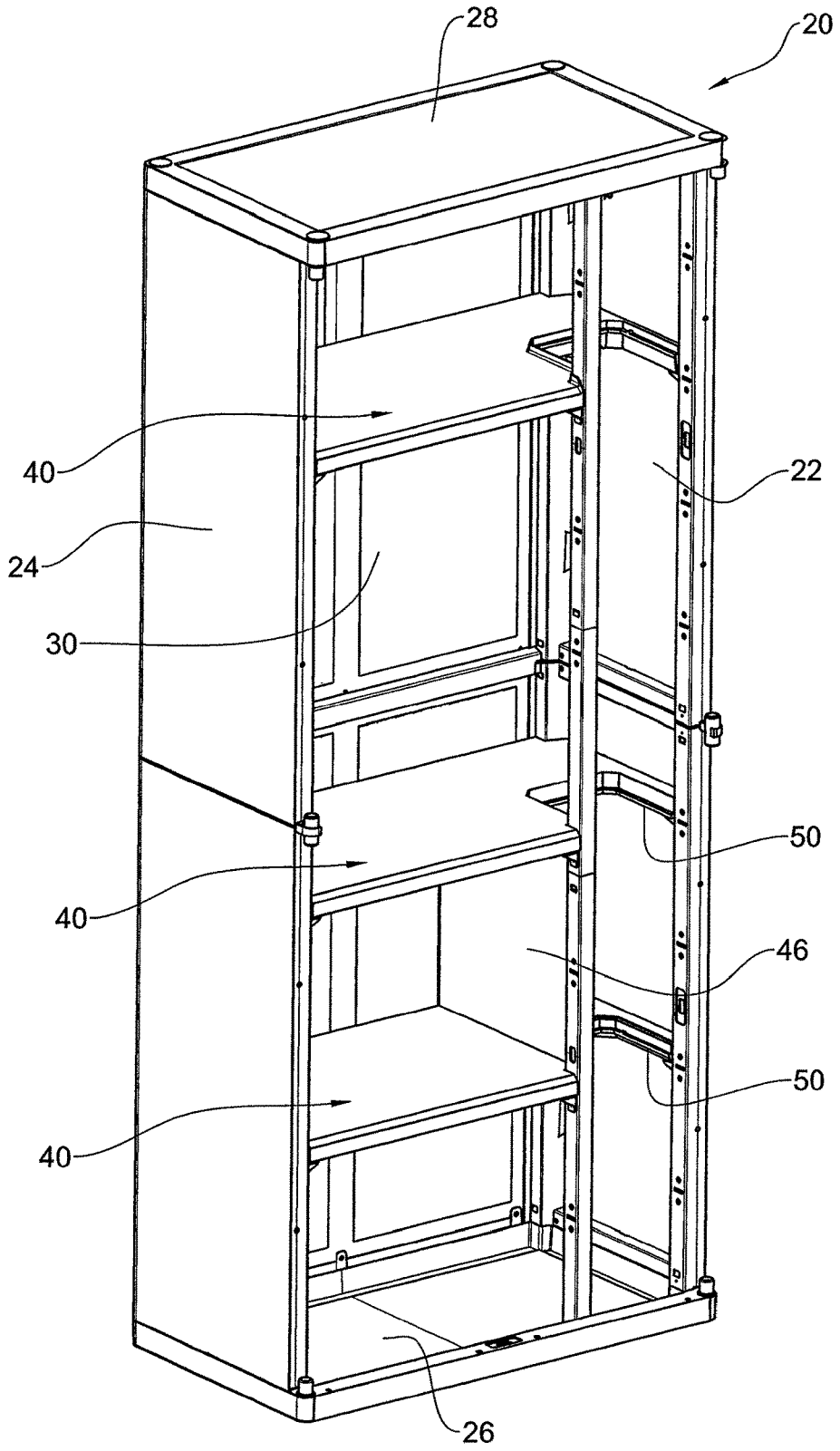
FIG. 1D is a left side perspective view of the storage cabinet of FIG. 1A, the doors removed.
Figures 2A, 2B, 2C, 2D, 2E:
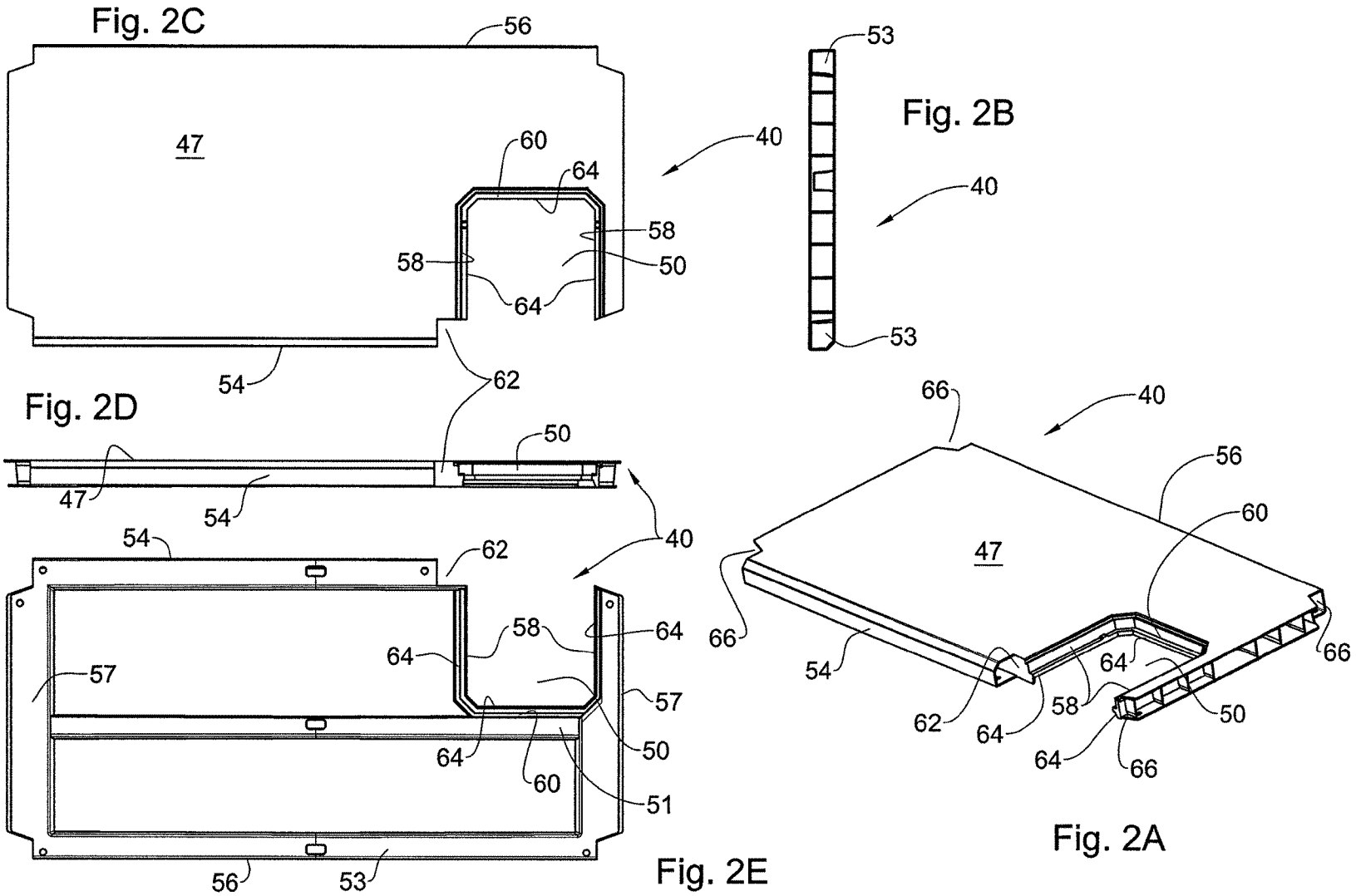
FIGS. 2A to 2E are different respective views of a modular shelf according to one example of the disclosure, excluding therefrom a cut-out complimentary cover member.
Figures 3A, 3B, 3C, 3D, 3E:
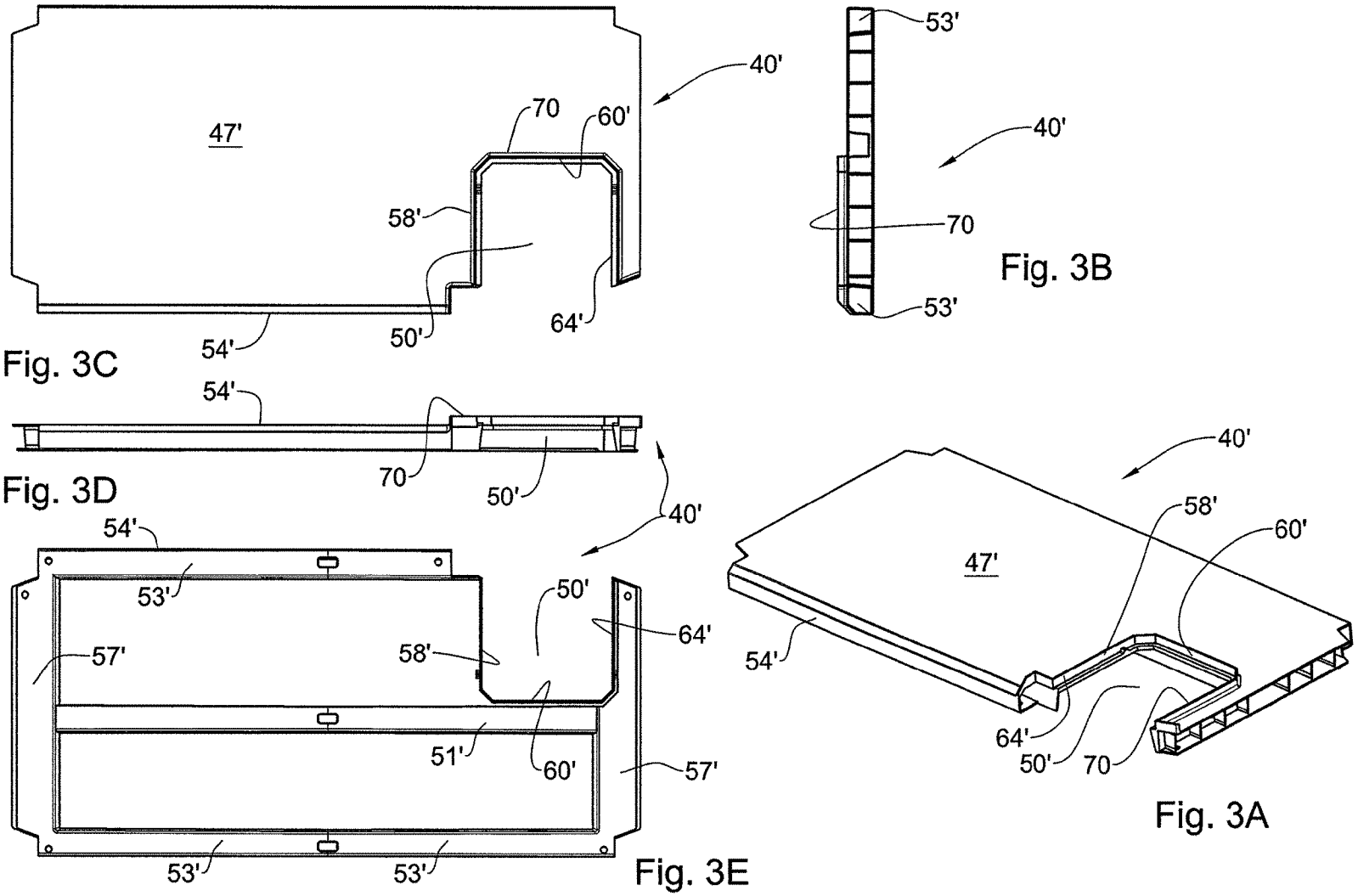
FIGS. 3A to 3E are different respective views of a modular shelf according to another example of the disclosure, excluding therefrom a cut-out complimentary cover member.
Figures 4A, 4B, 4C, 4D:
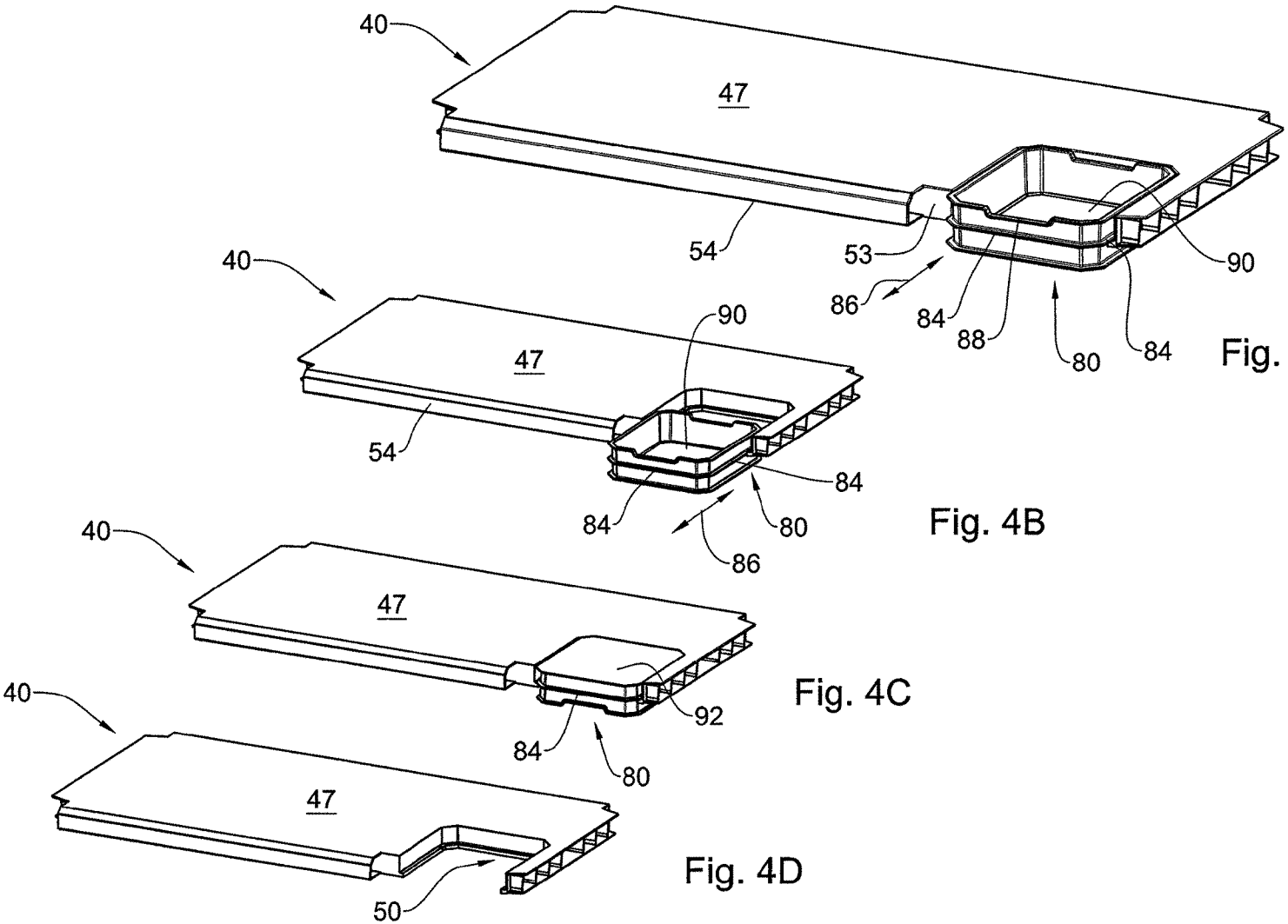
FIG. 4A illustrates a shelf fitted with a dual mode box-like cut-out complimentary cover member, the later at its compartment position.
FIG. 4B illustrates a first step of withdrawing the box-like cut-out complimentary cover member of FIG. 4A.
FIG. 4C illustrates the dual mode box-like cut-out complimentary cover member of FIG. 4A at its covering position, extending flush with a top surface of the shelf.
FIG. 4D illustrates the shelf of FIG. 4A without any cut-out complimentary cover member.
Figures 5A, 5B, 5C, 5D:
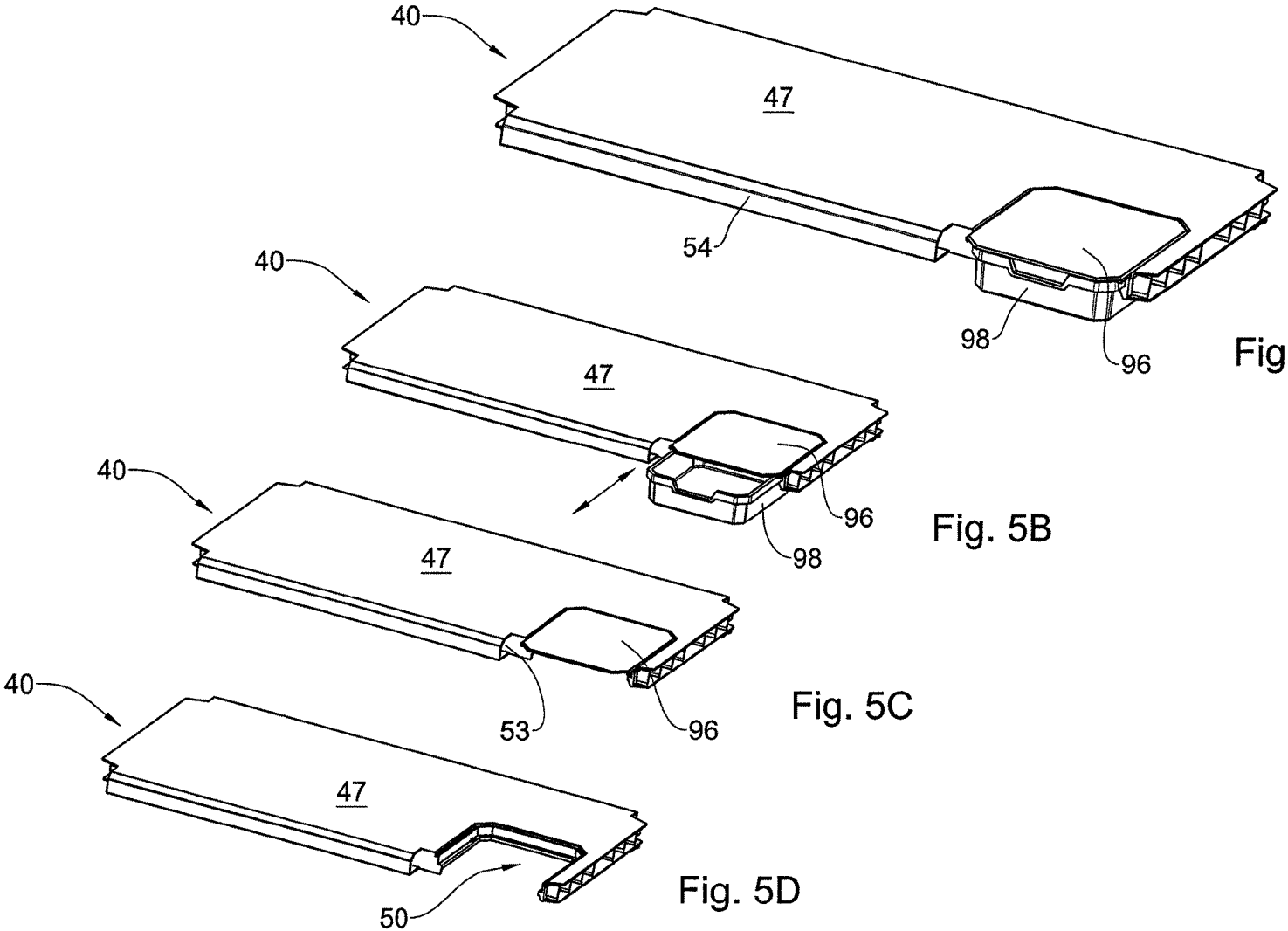
FIG. 5A illustrates a shelf fitted with a drawer-like cut-out complimentary cover member, the later at its closed compartment position.
FIG. 5B illustrates sliding the drawer-like compartment into its open position, however with a top cover remaining in position flush with a top surface of the shelf.
FIG. 5C illustrates the drawer-like compartment of FIG. 5B removed, however with the top cover remaining in position flush with a top surface of the shelf
FIG. 5D illustrates the shelf of FIG. 5A without any cut-out complimentary cover member.

Attention is directed to FIGS. 1A to 1D of the drawings illustrating a storage system, namely a cabinet, generally designated 20.

The cabinet 20 comprises a right side wall 22, a left side wall 24, a bottom wall 26, a top wall 28 and a rear panel 30. A right door 32 and a left door 34 are hingedly articulated to the right wall 22 and the left wall 24, respectively.

As noted in the drawings, the cabinet 20 is fitted with three modular shelves generally designated 40, best seen in FIGS. 2 to 6. The number of shelves within a cabinet can vary and likewise, the shelves can be positioned within the cabinet 20 at different elevations, owing to a height adjusting system, as known in the art. In the particular example, the shelves 40 occupy the entire horizontal section area of the cabinet 20, i.e. extend against and are supported within the cabinet 20 over the right side wall 22, left side wall 24 and extending against the rear panel 30. It will be appreciated that while the following description relates to the above configuration, the storage system can be devoid for example the rear panel, the storage system can be a built in niche storage system, such that the left wall and the right wall are part of the niche, holding structure.

Figure 9:
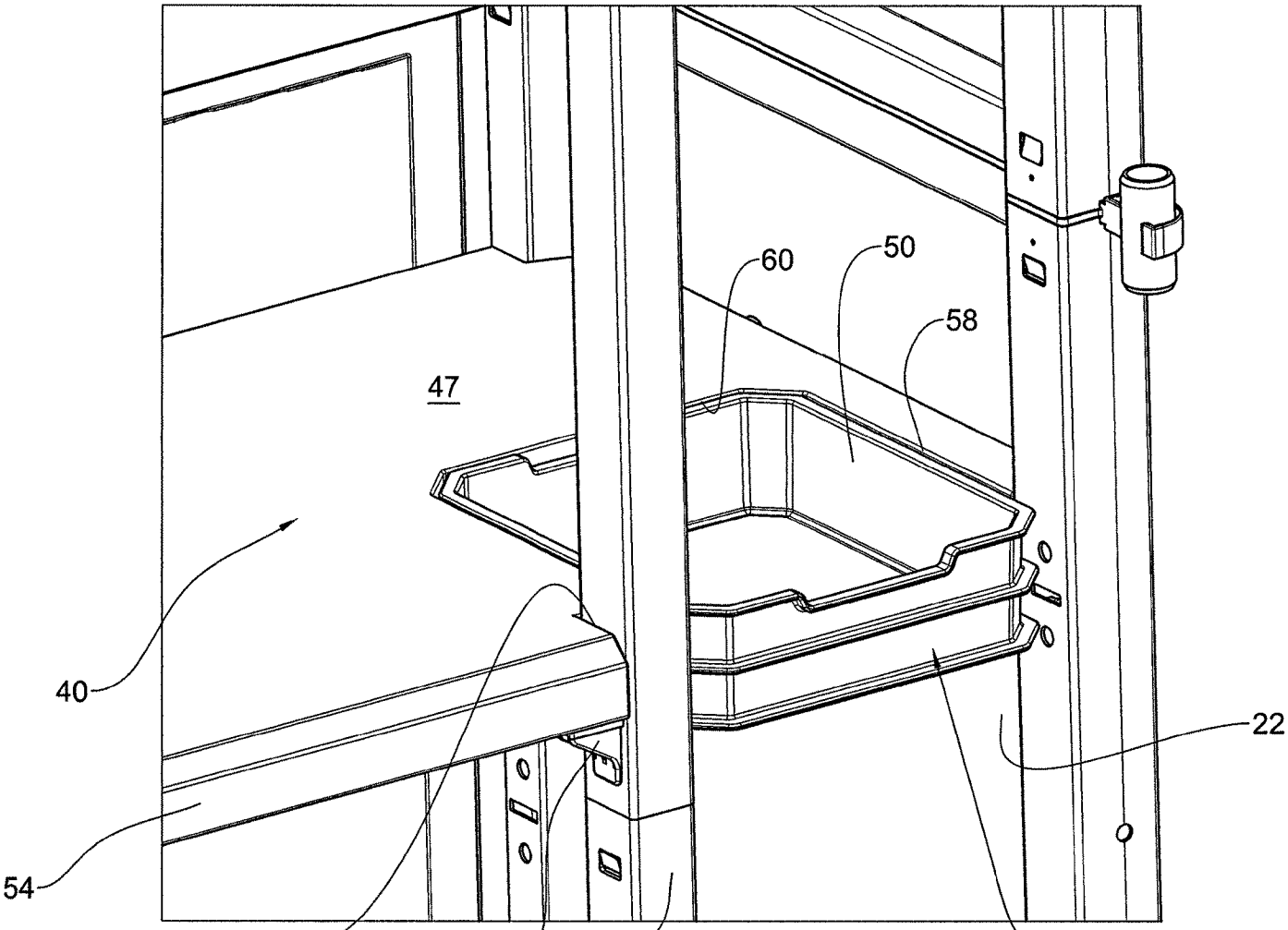
FIG. 9 is an enlargement of the portion marked IX in FIG. 1A.

Further noted, the modular shelves 40 are supported, at their front side, by a support post 44 extending from the bottom wall 26 to the top wall 28, wherein each shelf 40 is articulatedly supported thereto as can best be seen in FIG. 9, in a fashion facilitating changing the elevation of the respective shelves within the cabinet. It is appreciated that the support post 44 does not interfere with the closing of the front doors 32 and 34. Furthermore, according to another example, the support post 44 can serve for supporting vertical partition walls (e.g. modular partition wall 46 in FIG. 1D) extending towards the back panel 30 and thus forming internal vertical partitions within the cabinet.

In the present example the cabinet 20 is configured with three modular shelves 40. It is however appreciated that a cabinet can comprise also one or more regular shelves as well (not shown).

Figure 7:
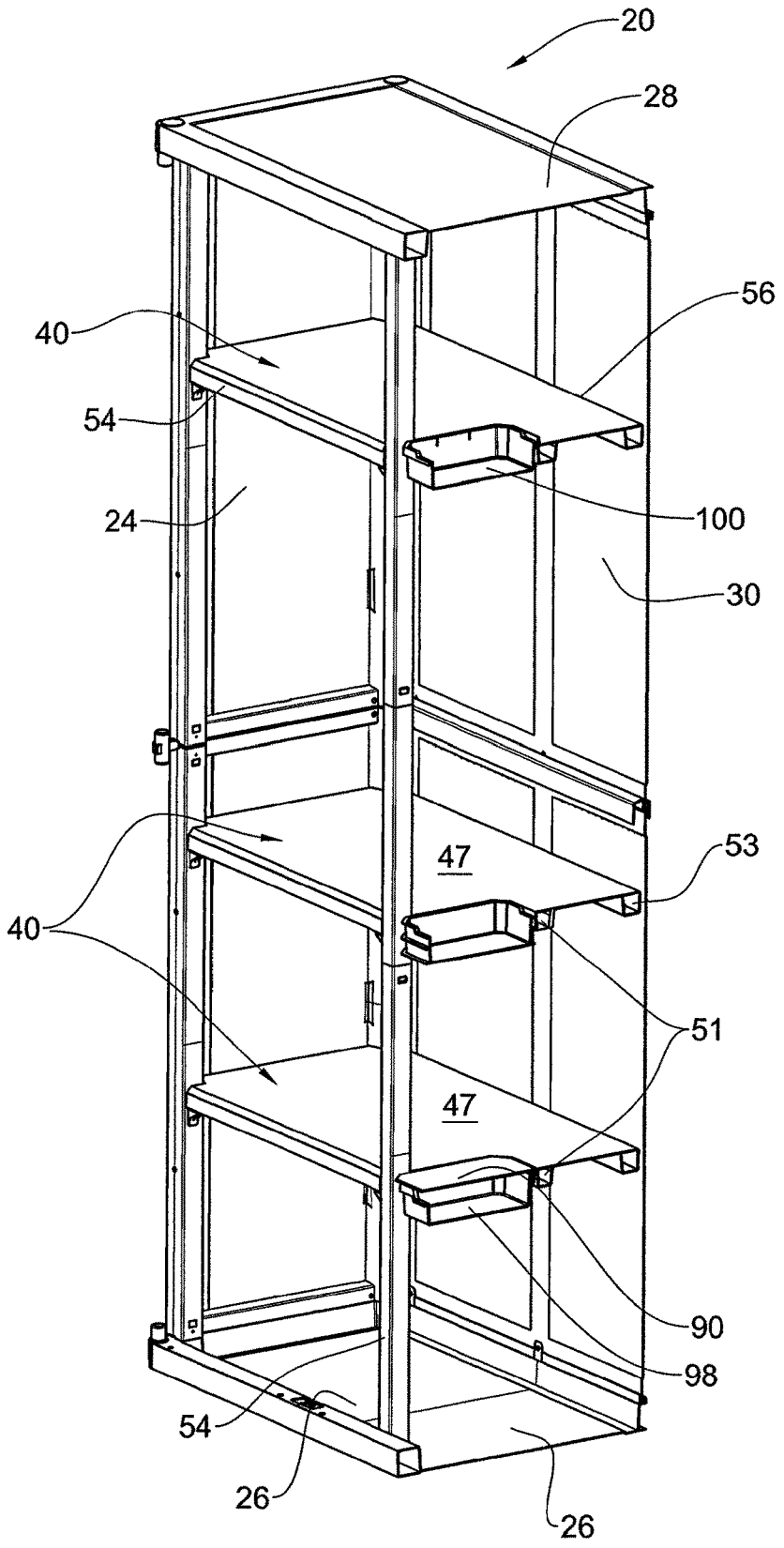
FIG. 7 is a longitudinal section along line VII-VII in FIG. 1C.
Figure 8:
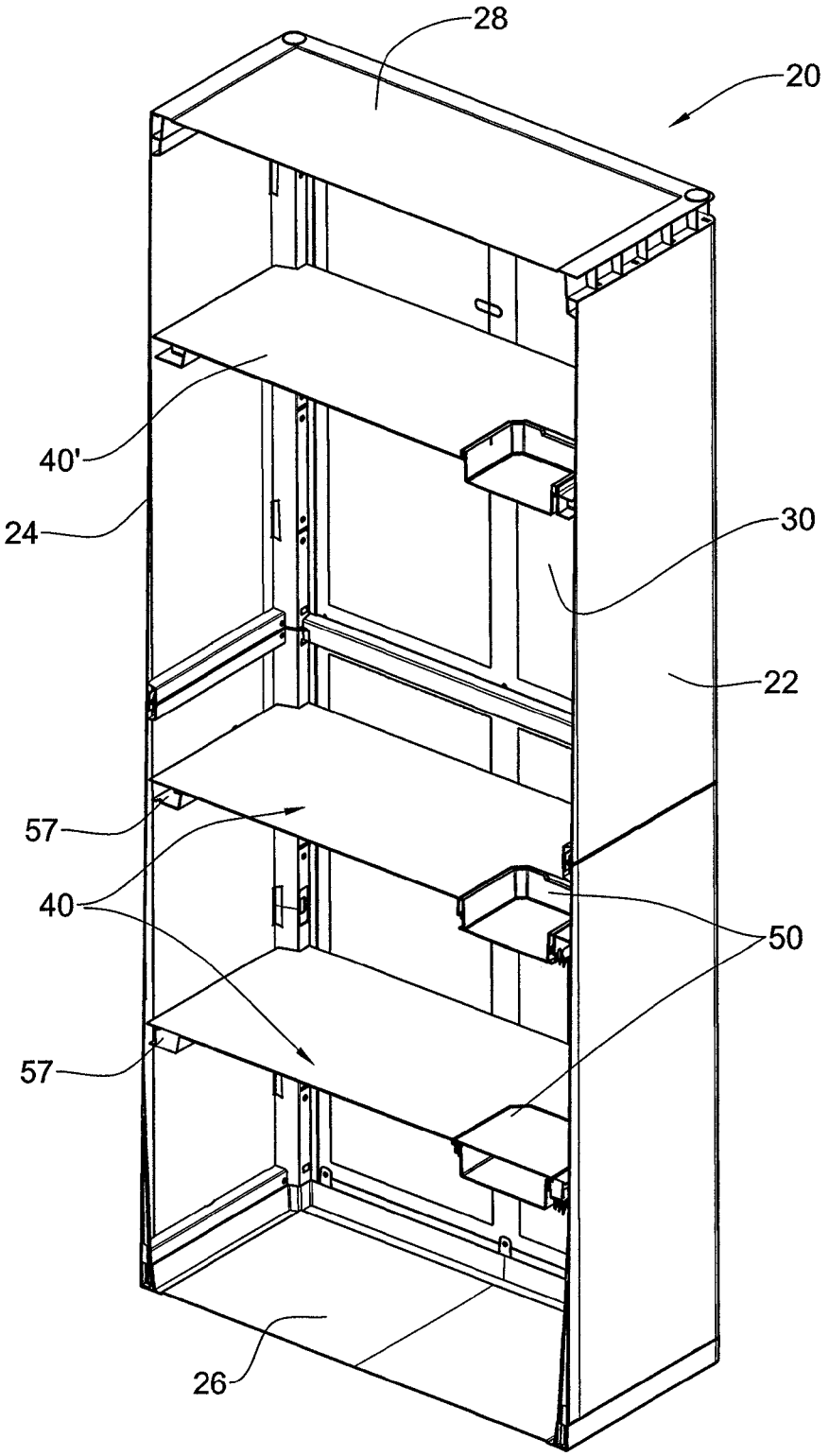
FIG. 8 is a longitudinal section along line VIII-VIII in FIG. 1C.

Each of the modular shelves 40 is configured with a cut-out portion 50 extending from a front face 54 of the modular shelf towards a rear edge 56 (FIG. 2A) of the shelf. The depth of the cut-out portion can vary and according to a particular design (not shown) can extend almost near to the rear edge 56 of the shelf, however maintain the shelf with sufficient strength to prevent its bending. If required, reinforcement can be added to prevent bending or buckling of the shelf. As can be seen also in FIG. 7 a bottom face of the shelf is configured at least at the rear side of the cut-out portion, with a longitudinal reinforcing core formation 51 (e.g. a hollow form similar to form 53 along a rear edge of the shelf). Likewise, side edges of the shelves 40 are configured with a hollow reinforcing core portion 57 (also seen in FIG. 8).

The cut-out portion 50 extends, in the particular example of FIGS. 2 to 6 at a right hand side portion of the shelf, and has two side walls 58 extending parallel to one another and at a right angle with respect to the front face 54 of the shelf 40, with a rear wall 60 substantially parallel to the front face 54 of the shelf. Whilst in the particular illustrated examples the cut-out portions have a rectangle shape, it is appreciated that other shapes can be configured as well, e.g. a U-shaped cut-out, semi-circular, etc. as can be seen in FIGS. 2A to 2E, the edges of the cut-out portion 50 are flush with at least the top face 47 of the modular shelf 40.

The side walls 58 and optionally the rear wall 60 of the cut-out 50 are configured with a lateral projection 64 serving as a supporting and guidance rail for a cut-out complimentary cover member as will be discussed hereinafter with further detail.

Also noted in FIGS. 2 to 6, the modular shelf 40 is configured with a support post recess 62, for articulating to the support post 44 and supporting, e.g., by bracket 64 (FIG. 9). In the drawings, the shelf 40 is configured with corner recesses 66 configured for interconnecting with internal reinforcement portions of side walls of the cabinet 20.

Turning now to FIGS. 3A to 3E there is illustrated a modular shelf according to a modification of the present disclosure, however being substantially similar to that disclosed in connection with FIGS. 2A to 2E and accordingly like elements are designated with same reference numbers with a (') indication.

In fact, the difference between the modular shelf 40 of FIGS. 2A to 2E and the modular shelf 40' of FIGS. 3A to 3E resides in the elevated perimeteric rim 70 projecting from the top face 47' of the modular shelf 40'. The perimeteric rim 70 serves for reinforcing the shelf at the vicinity of the cut out 50' and further facilitates the accommodation of a cut-out complimentary cover member thicker than the overall thickness of the shelf 40', as illustrated for example in FIGS. 6A to 6C. Furthermore, the cut-out portion 50' is configured with a peripheral recess 64' at a top portion of the side walls and back wall of the cut-out, for slidingly receiving a respective cut-out complimentary cover member.

Turning now to FIGS. 4A to 4D there is illustrated the use of a box-like cut-out complimentary cover member 80 (clearly seen also in FIG. 9). The box-like cut-out complimentary cover member 80 is has a rectangular cross section, substantially conforming with the size and shape of the cut-out portion 50 of the modular shelf 40.

The box-like cut-out complimentary cover member 80 is configured at its outside side walls with a lateral perimeteric rail configured for sliding engagement with corresponding lateral projection 64 of the side walls 58 and the rear wall 60 of the cut-out 50, whereby the cut-out complimentary cover member 80 can be placed within the cut-out portion 50 and can be slidingly displaced in and out from the front edge 54 of the modular shelf 40, along arrowed line 86. The cut-out complimentary cover member 80 is fitted with recesses 88 to facilitate grip thereof. At the first operative position (FIGS. 4A and 4B), the box-like cut-out complimentary cover member 80 serves as a storage compartment for storing small items within the box space 90. If required, the box space 90 can be partitioned (not shown) for the storage of different small articles.

At a second operative position (FIG. 4C) the box-like cut-out complimentary cover member 80 is placed within the cut-out portion 50 of the modular shelf 40 bottom-up, such that its bottom face 92 covers the cut-out portion and is substantially flush with the top face 47 of the shelf 40.

In the example of FIGS. 5A to 5D there is illustrated a shelf 40 according to the disclosed subject matter, wherein the cut-out portion 50 is coverable by a cut-out complimentary cover member configured as a cover plate 96 secured over the cut-out portion (e.g. by projections and respective recesses, or by press-fit, etc.) and extending flush with the top face 47 of the shelf 40. Further there is provided a tray member 98 slidingly received under said cover plate 96 and is displaceable between a closed position (FIG. 5A), an open, accessible position (FIG. 5B) and a removed position (FIG. 5C where the cover plate 96 remains in place and 5D wherein both the cover plate 96 and the tray member 98 are removed).

Figures 6A, 6B, 6C:
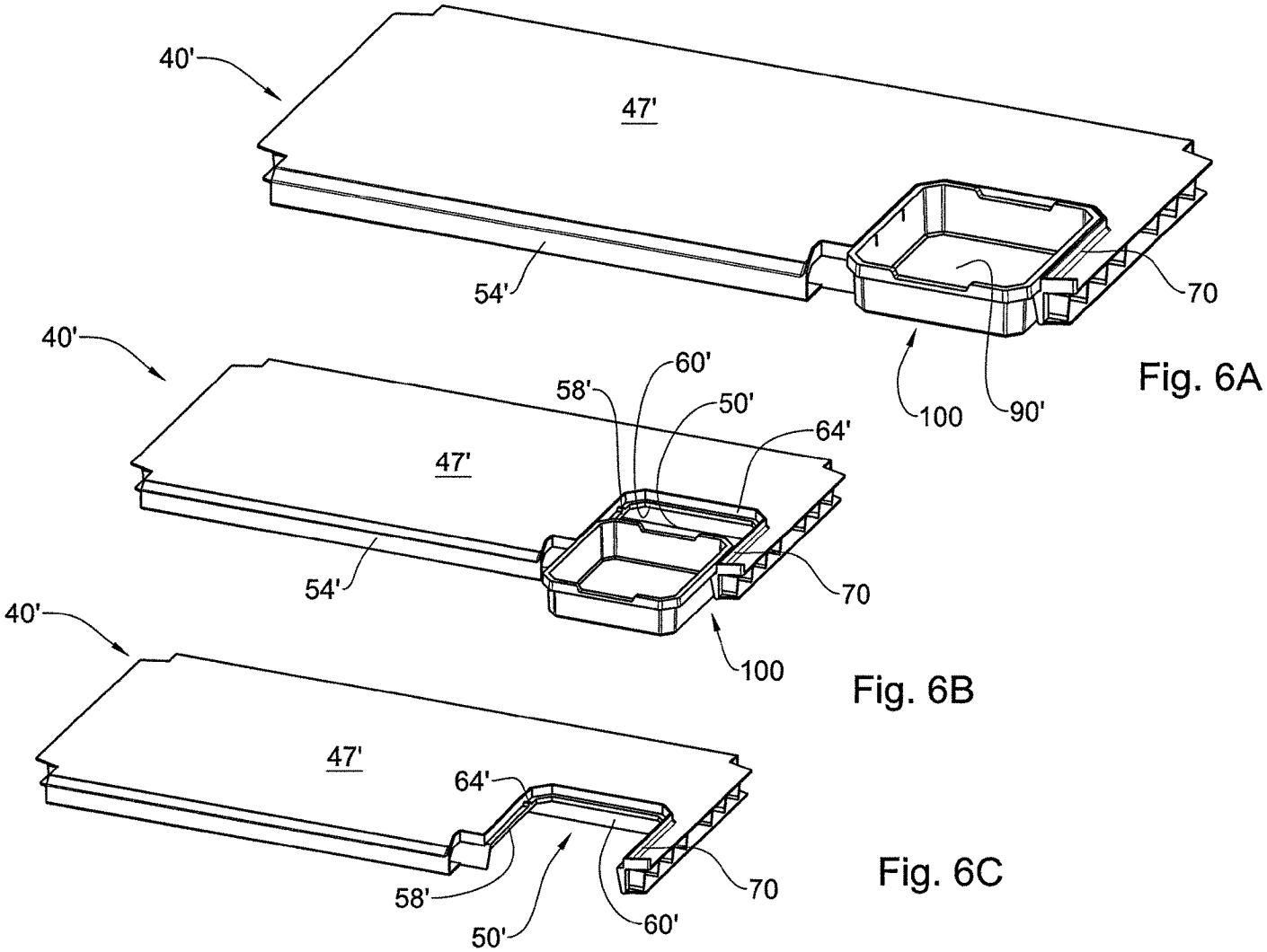
FIG. 6A illustrates a shelf configured with a reinforced, elevated cut-out portion and accommodating dual mode box-like cut-out complimentary cover member, the later at its compartment position.
FIG. 6B illustrates sliding out of the box-like cut-out complimentary cover member.
FIG. 6C illustrates the shelf of FIG. 6A without any cut-out complimentary cover member.

In the example illustrated in FIGS. 6A to 6C there is illustrated a modular shelf 40', of the type disclosed in connection with FIG. 3A to 3E, accommodating a sliding box-like cut-out complimentary cover member 100 similar to the disclosure of FIGS. 4A to 4D, however wherein the box-like cut-out complimentary cover member 100 is slidingly displaceable with respect to the cut-out portion 50' of the shelf 40' over the peripheral recess 64' near the top end of the side walls 58' and the rear wall 60' of the cut-out portion 50'. Likewise, the box-like cut-out complimentary cover member 100 is configurable between a first operative position (FIGS. 6A and 6B) serving as a storage compartment for small goods placeable within space 90' of the box-like member.

Figure 10A:
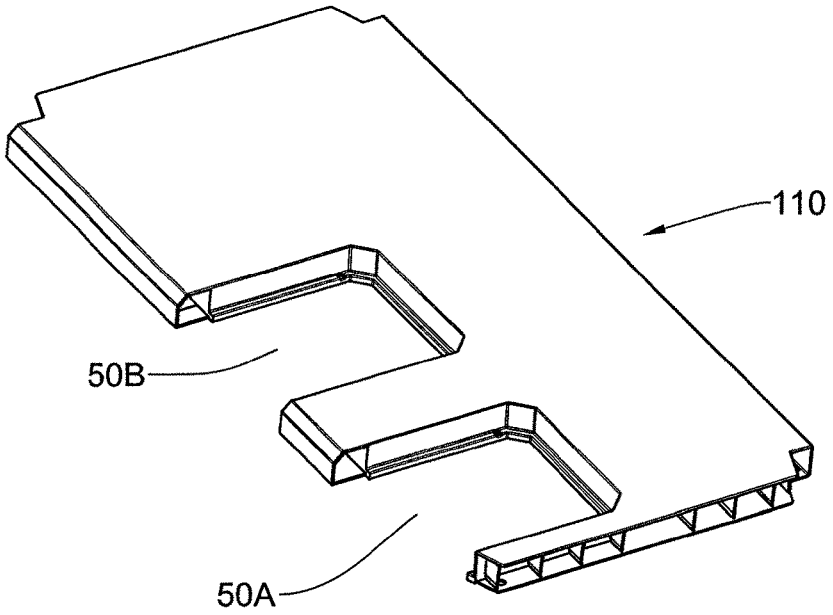
FIGS. 10A and 10B illustrate modular shelves according to modifications of the present disclosure.
Figure 10B:
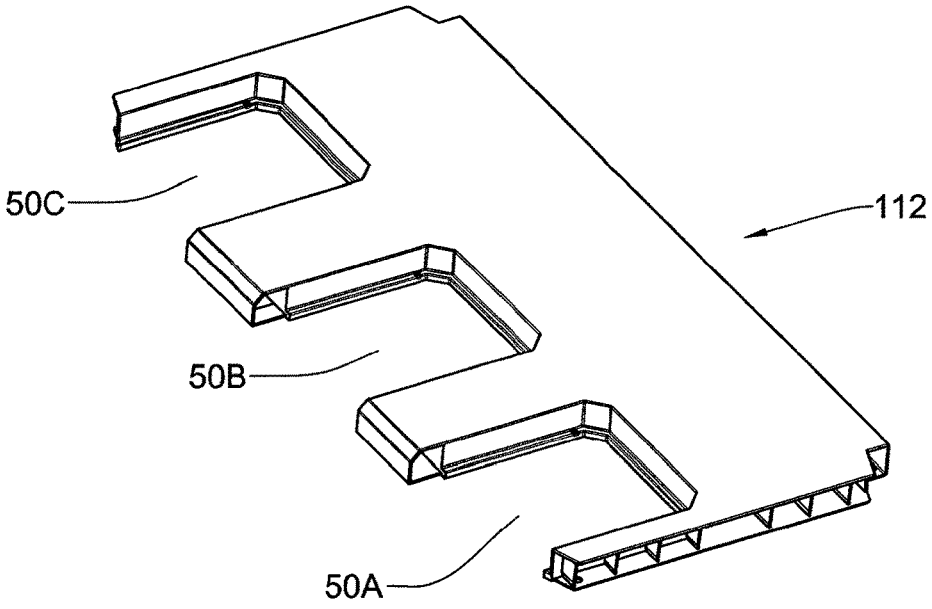

In the example of FIG. 10A there is illustrated a modular shelf 110 according to another example of the disclosure, the shelf being substantially similar to that disclosed hereinabove, with the exception that it is configured with two cut-out portions 50A and 50B, similar to the configuration of cut-out 50 as discussed earlier. In FIG. 10B there is a shelf 112 which too is similar to the previous disclosed shelves, however configured with three cut-out portions 50A, 50B and 50C.

Figure 11A:
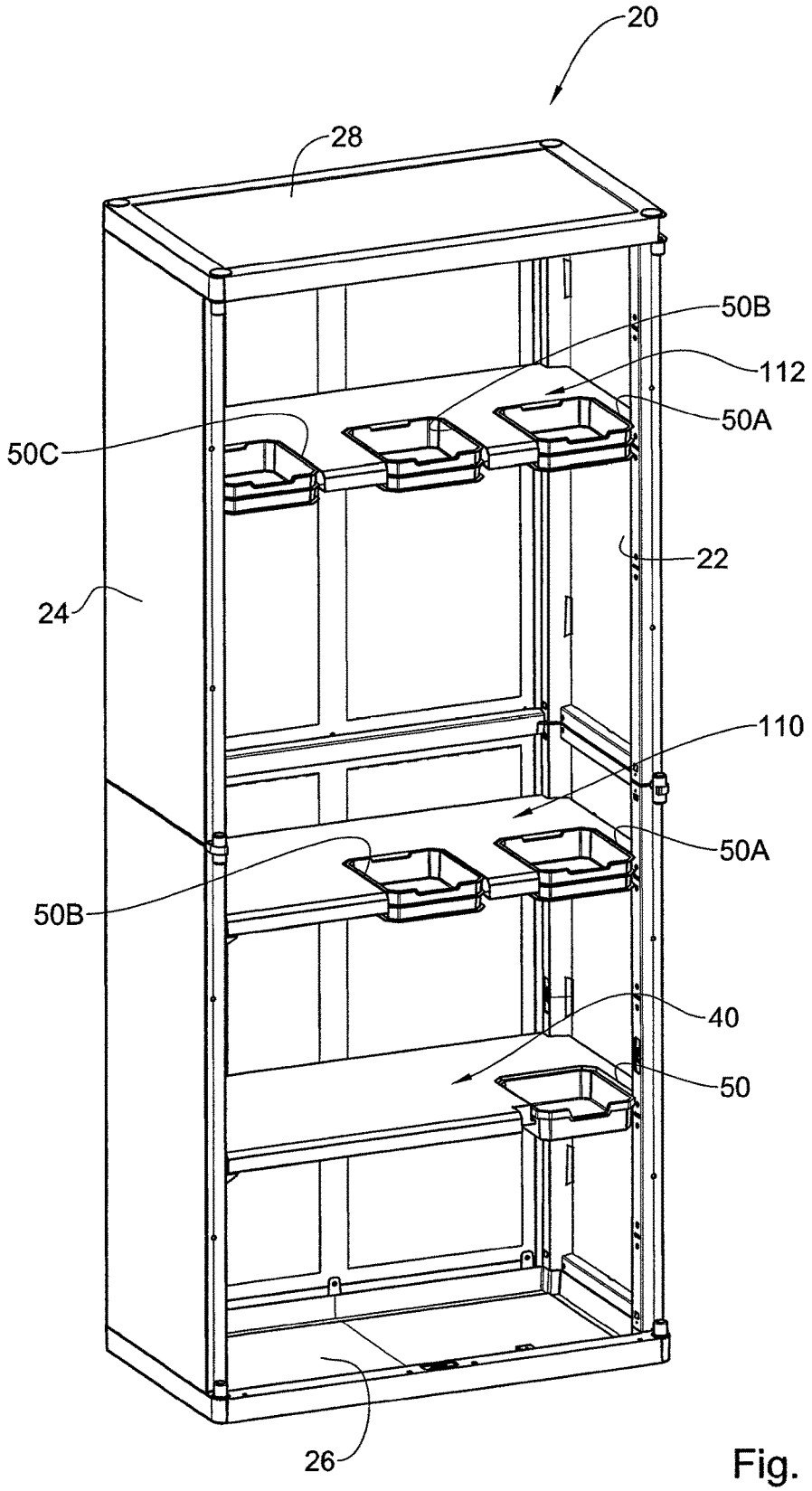
FIGS. 11A to 11C illustrate a storage cabinet with the doors removed, the modular shelves being a modification of the disclosed subject matter, and illustrating different operative positions imparted by the accommodation of the cut-out complimentary cover members.
Figure 11B:
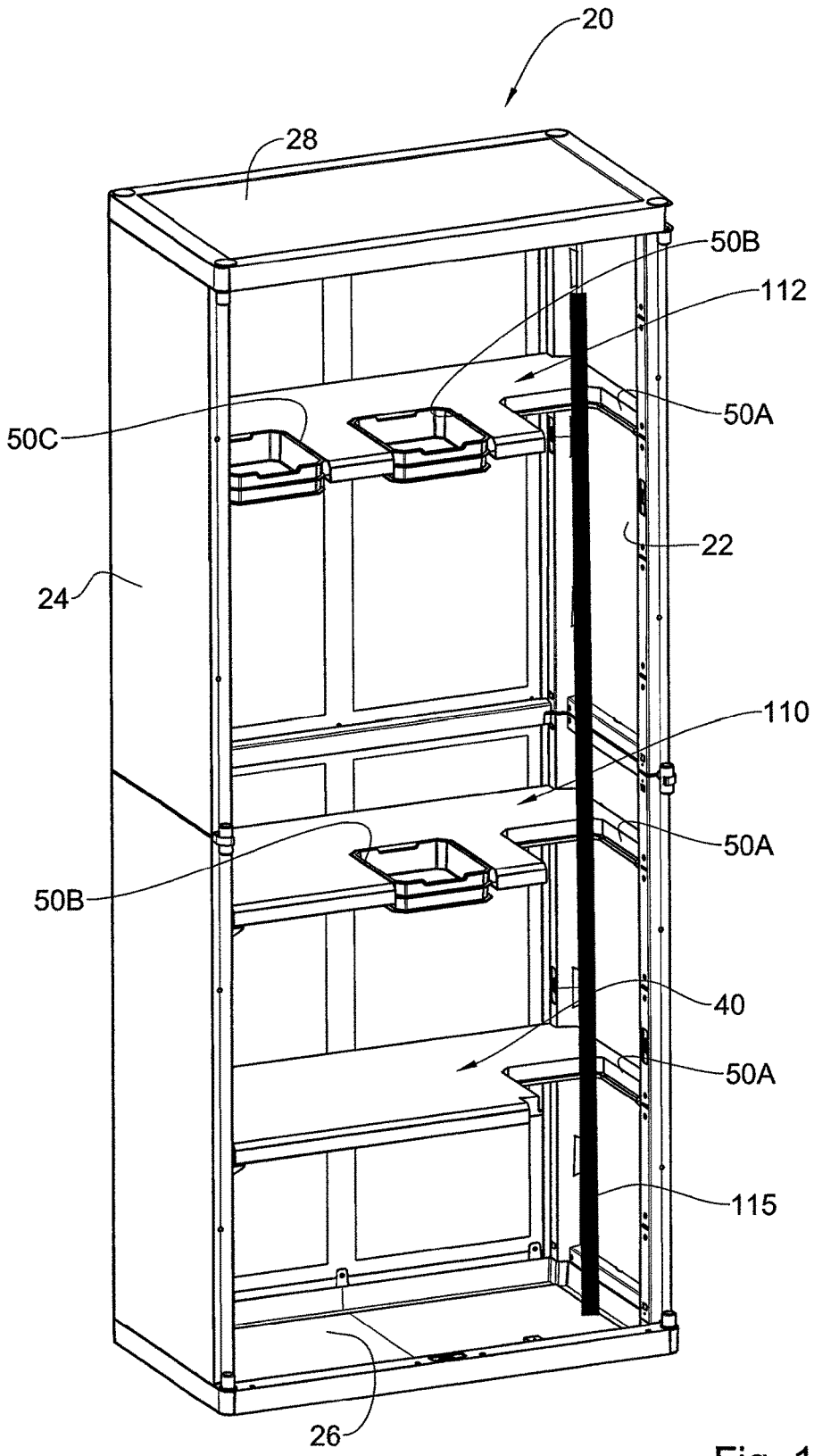
Figure 11C:
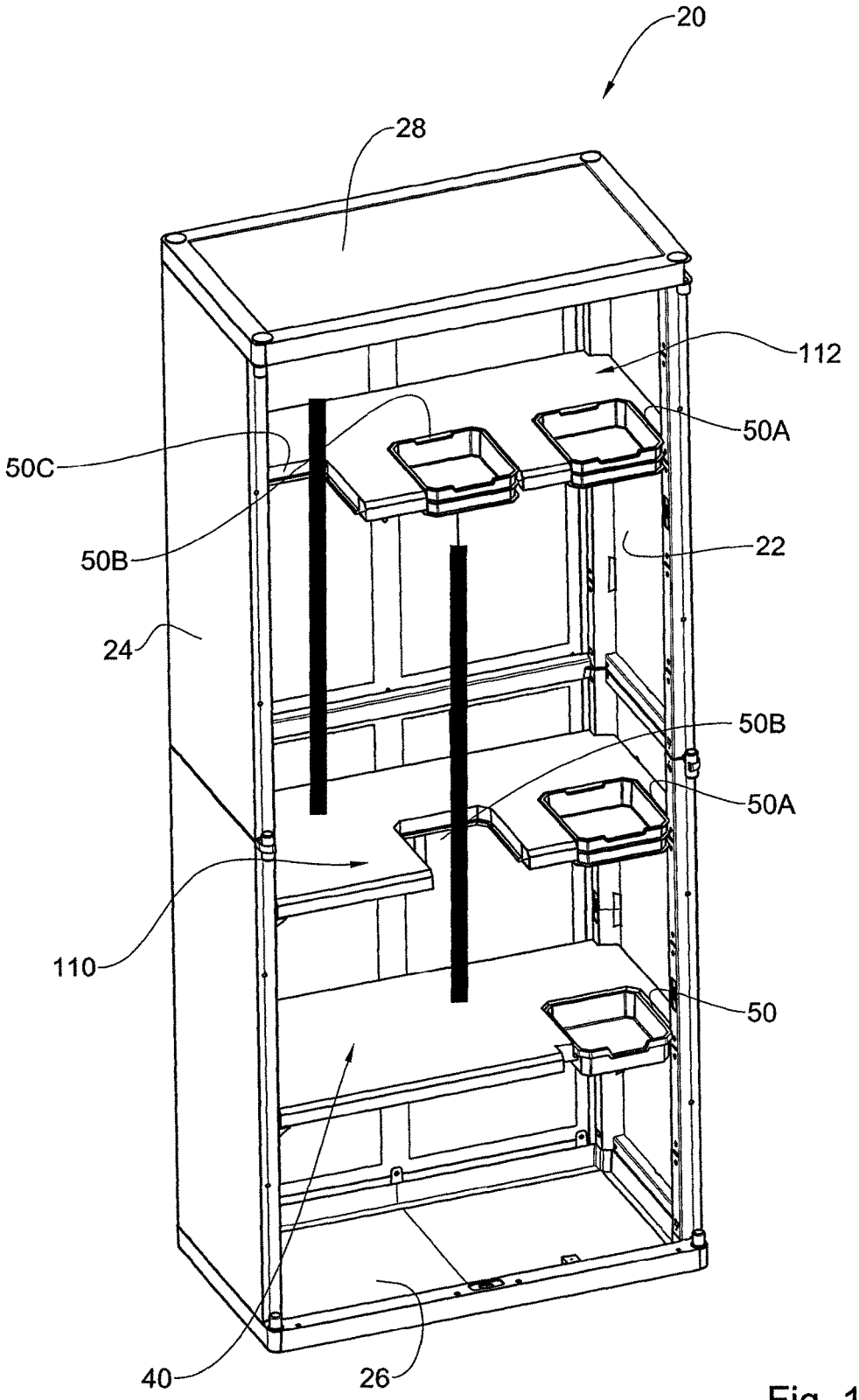

Turning now to FIGS. 11A to 11C there are illustrated several configurations of a storage cabinet 20 according to the disclosure, accommodating three modular shelves 40, 110 and 112 respectively, as discussed hereinabove.

In FIG. 11A all the respective cut-out complimentary cover members are received within their respective cut-out portions 50A, 50B and 50C of the three shelves 40, 110 and 112, respectively. In the particular example the cut-out complimentary cover members are box-like members, as discussed hereinabove for example in connection with FIG. 4, though as appreciated, other types of cut-out complimentary cover members can be used.

In FIG. 11B three co-extending (i.e. one on top of another) cut-out complimentary cover members are removed from the three respective shelves 40, 110 and 112, giving rise to a coextending continuous space (represented schematically by a thick line designated 115), whereby long items can be placed in the storage cabinet 20, e.g. a broom, a ladder and the like.

In FIG. 11C one cut-out complimentary cover member has been removed from cut-out portion 50C of the topmost modular shelf 112 and one cut-out complimentary cover member has been removed from cut-out portion 50B of the middle modular shelf 110, thus giving rise to two coextending continuous space zones (represented schematically by a thick lines designated 115A and 115B, respectively) for storage of larger/longer items.

It is thus appreciated that removal of one or more cut-out complimentary cover members from their respective cut-out portion forms an extended storage space spanning between the space bellow the respective modular shelf and above said respective modular shelf, thus rendering it suitable for storage of articles higher than the height of at least the space bellow the respective modular shelf.

In the particular illustrated examples, the storage system is a cabinet, fitted with doors. It is however appreciated that other configurations of storage systems are optional, all of which fall within the scope of the present disclosure. For example, the cabinet can be a so-called 'built-in' cabinet, i.e. fitted within a partial or a complete niche. The storage system can be other forms of cabinets such as with sliding doors or no doors at all, a shelving system (e.g. without one or more of side walls, a back panel and top/bottom walls, etc.) and further envisioned is a shelving system in which the one or more shelves are supported at least by two or more side support posts bearing and/or supporting the shelves thereon.

The invention claimed is:

1. A storage system, comprising:

a right wall and a left wall defining a storage space;

at least one door articulated to the right or left wall for concealing the storage space;

at least one shelf support post;

one or more modular shelves within the storage system for horizontally partitioning the storage space, the one or more modular shelves being supported by the at least one shelf support post, wherein at least one of the one or more modular shelves is configured with a first at least one cut-out portion extending from a front face of said one or more modular shelves towards a rear portion thereof and the shelf support post being articulated to one or more modular shelves adjacent the cut-out portion and received within a support post recess formed in the one or more shelves, such that a front face of the shelf support post is flush with a front face of the one or more modular shelves, the cut-out portion being defined within the modular shelf between two side walls extending parallel to one another and at a right angle with respect to the front face of the modular shelf, a rear wall substantially parallel to the front face of the modular shelf, and an opening at the front face of the modular shelf, at least each of the side walls of the cut-out being configured with a lateral projection;

at least one cut-out complimentary cover member for attaching to the one or more modular shelves and covering at least a portion of the first at least one cut-out portion; and one or more support posts configured for supporting the one or more modular shelves such that the one or more support posts are configured for extending from either or both a top and a bottom of the storage system, the first at least one cut-out portion of the one or more modular shelves is configured for slidingly receiving the at least one cut-out complimentary cover member, said lateral projection supports and guides the cut-out complimentary cover when received in the cut-out such that the cut-out complementary cover being slidingly displaceable in and out of the cut-out portion from the opening in the front face of the modular shelf by lateral sliding along the projection supports, the at least one cut-out complimentary cover member is configured for detachable attachment over or within the cut-out portion, and configured with at least a surface portion extending flush with at least a top face of the one or more modular shelves when being received in said cut-out portion.

2. The storage system in accordance with claim 1, wherein the storage system is a cabinet at least partially composed of a plastic material, fitted with one or more doors.

3. The storage system in accordance with claim 1, wherein the first at least one cut-out portion extends proximally to a rear edge of the one or more modular shelves, maintaining at least a rear continuous edge opposite an open edge of the first at least one cut-out portion.

4. The storage system in accordance with claim 1, wherein the at least one cut-out complimentary cover member is configured for sliding or pivotal displacement between a complimenting position, wherein the at least one cut-out complimentary cover member at least partially compliments the first at least one cut-out portion, and an open position wherein it is displaced from the first at least one cut-out portion.

5. The storage system in accordance with claim 1, wherein the rear wall of the first at least one cut out portion is provided with rails or projections.

6. The storage system in accordance with claim 1, wherein the at least one cut-out complimentary cover member and the first at least one cut-out portion of the one or more modular shelves is configured with a locking or arresting mechanism for retaining the at least one complimentary cut-out cover member at either of its respective complimenting position and open position.

7. The storage system in accordance with claim 1, wherein the at least one cut-out complimentary cover member is configured with a first side being a substantially flat surface complimenting a top surface of a shelf, and a second side being a storage compartment, wherein the at least one cut-out complimentary cover member is articulated with the first at least one cut-out portion with either its first side or its second side facing upwards.

8. The storage system in accordance with claim 1, wherein the one or more modular shelves is reinforced along a portion of a rear edge thereof, at least opposite the first at least one cut-out portion.

9. The storage system in accordance with claim 1, wherein the one or more modular shelves is configured with a second one or more cut-out portions at a rear face of the one or more modular shelves and extending towards a front portion of the one or more modular shelves, respectively.

10. The storage system in accordance with claim 1, wherein the first at least one cut-out portion of the one or more modular shelves is configured with an elevated rim portion facilitating accommodation of a thicker cut-out complimentary cover member.

11. The storage system in accordance with claim 1, wherein the one or more modular shelves is reinforced by reinforcing elements articulated or integrated with the one or more modular shelves.

12. A modular shelf for use with a storage system of claim 1, the modular shelf comprising at least one cut-out portion extending from a front face of the modular shelf towards a rear portion of the modular shelf, the cut-out portion being defined within the modular shelf between two side walls extending parallel to one another and at a right angle with respect to the front face of the modular shelf, a rear wall substantially parallel to the front face of the modular shelf, and an opening at the front face of the modular shelf, at least each of the side walls of the cut-out being configured with a lateral projection;

the cut-out being configured for slidingly receiving, in a detachable attachment manner, a cut-out complimentary cover member having a surface portion, the cut-out being configured such that once the complimentary cover member is received therein, the complimentary cover member extends flush with a top face of the shelf, and said lateral projection configured for supporting and guiding the cut-out complimentary cover member when received in the cut-out.

13. The modular shelf according to claim 12, wherein the modular shelf is configured with a cut-out complimentary cover member, for attaching to the modular shelf and covering at least a portion of the at least one cut-out portion.

14. A cut-out complimentary cover member attached to the modular shelf of the storage system of claim 1, said cut-out complimentary cover member is configured for covering at least a portion of a cut-out portion of said modular shelf and at least partially conforming to the shape and size of the cut-out portion of the modular shelf, said cut-out complimentary cover member configured for being slidably received within the cut-out portion of the modular shelf through an opening at the front face of the modular shelf, cut-out complimentary cover member configured to be supported and guided by a lateral projection projecting from side walls of the cut-out portion when received in the cut-out, wherein the cut-out complimentary cover member is configured with at least a surface portion that is configured to extend flush with at least a top face of the modular shelf once associated with the modular shelf.

15. The complimentary cut-out cover member in accordance with claim 14, wherein the cut-out complementary cover member is a box-shaped element configured for nestable stacking.

* * * * *